US011382192B2

(12) United States Patent
Larson et al.

(10) Patent No.: US 11,382,192 B2
(45) Date of Patent: Jul. 5, 2022

(54) PREFERRED LIGHTING SPECTRUM AND COLOR SHIFTING CIRCADIAN LAMPS

(71) Applicant: Lucidity Lights, Inc., Charlestown, MA (US)

(72) Inventors: Bruce C. Larson, Lexington, MA (US); John R. Goscha, Boston, MA (US); Ellen Bossert, Needham Heights, MA (US)

(73) Assignee: Lucidity Lights, Inc., Charlestown, MA (US)

( * ) Notice: Subject to any disclaimer, the term of this patent is extended or adjusted under 35 U.S.C. 154(b) by 127 days.

(21) Appl. No.: 16/784,480

(22) Filed: Feb. 7, 2020

(65) Prior Publication Data

US 2020/0260543 A1 Aug. 13, 2020

Related U.S. Application Data

(60) Provisional application No. 62/802,803, filed on Feb. 8, 2019.

(51) Int. Cl.
*H05B 45/10* (2020.01)
*H05B 45/20* (2020.01)
*H05B 47/16* (2020.01)

(52) U.S. Cl.
CPC ..... *H05B 45/10* (2020.01); *H05B 45/20* (2020.01); *H05B 47/16* (2020.01)

(58) Field of Classification Search
None
See application file for complete search history.

(56) References Cited

U.S. PATENT DOCUMENTS

| | | | |
|---|---|---|---|
| 6,407,514 | B1 | 6/2002 | Glaser et al. |
| 6,977,472 | B2 | 12/2005 | Matsubayashi et al. |
| 7,014,336 | B1 | 3/2006 | Ducharme et al. |
| 7,038,399 | B2 | 5/2006 | Lys et al. |
| 7,182,480 | B2 | 2/2007 | Kan |
| 7,255,457 | B2 | 8/2007 | Ducharme et al. |
| 7,255,458 | B2 | 8/2007 | Ashdown |
| 7,348,604 | B2 | 3/2008 | Matheson |
| 7,352,138 | B2 | 4/2008 | Lys et al. |
| 8,841,864 | B2 | 9/2014 | Maxik et al. |

(Continued)

FOREIGN PATENT DOCUMENTS

WO 2018160361 A1 9/2018

OTHER PUBLICATIONS

"Bios® Skyblue® Lighting Solutions + Bio-Dimming", Bios, https://www.bioshumanlight.com/wp-content/uploads/2019/06/03-BIOS-SkyBlue-Lighting-Solutions-Bio-Dimming.pdf (accessed Feb. 19, 2020), Jun. 11, 2019, 2 pages.

(Continued)

*Primary Examiner* — Dedei K Hammond
(74) *Attorney, Agent, or Firm* — Dinsmore & Shohl LLP

(57) ABSTRACT

A dimmable circadian lighting system is provided that includes a light source and a control circuit in electrical communication with the light source and a dimmer. The control circuit is operative to vary a corelated color temperature (CCT) of the light source based on a signal from the dimmer; and maintain approximately a same lumen output of the light source across an upper transition zone of the dimmer extending from about 70% or greater of a range of the dimmer to about 100% of the range of the dimmer.

19 Claims, 13 Drawing Sheets

(56) References Cited

U.S. PATENT DOCUMENTS

| | | | | |
|---|---|---|---|---|
| 9,736,895 | B1 | 8/2017 | Dong et al. | |
| 9,827,440 | B2 | 11/2017 | Moore-Ede et al. | |
| 10,159,131 | B1 * | 12/2018 | Chaimberg | H05B 45/46 |
| 10,234,091 | B1 | 3/2019 | Chaimberg et al. | |
| 2019/0373700 | A1 * | 12/2019 | Meir | H05B 45/20 |
| 2021/0045220 | A1 * | 2/2021 | Barna | H05B 45/10 |

OTHER PUBLICATIONS

"Circadian® Zirc™ LED Technology", Circadian ZircLight Inc., https://www.circadianlight.com/images/pdfs/Spec%20Sheets/CIRCZircLED01132020.pdf (accessed Feb. 19, 2020), 2019, 2 pages.

"Globe Electric 91416 DuoBright Recessed Light, White", Amazon, https://www.amazon.com/Globe-Electric-91416-DuoBright-Recessed/dp/B07Y2HTT3Q/ref=sr_1_9?keywords=duo+bright+globe+electric&qid=1582040561&sr=8-9 (accessed Feb. 19, 2020), 7 pages.

"Suntrac® A19 Bulbs & Sunlync® | Automation Bundles", Healthe by Lighting Science, https://healthelighting.com/collections/suntrac/products/suntrac-sunlync-automation-bundles (accessed Feb. 19, 2020), 2020, 3 pages.

"Globe Electric Company, 33132 65 Watt Equivalent, BR30 LED, Dimmable Light Bulb, Warm White (2700K) E26/Medium (Standard) Base (Set of 2)", Wayfair.com, https://www.wayfair.com/lighting/pdp/globe-electric-company-65-watt-equivalent-br30-led-dimmable-light-bulb-warm-white-2700k-e26medium-standard-base-htbm1406.html, accessed online on Feb. 4, 2020), 12 pages.

Kitchin, "High Performance Regenerative Receiver Design", QEX, Nov./Dec. 1998, pp. 24-36.

Moore-Ede, "Investment Opportunity Executive Summary", Circadian Light, www.circadianlight.com, Release Oct. 2018, 2 pages.

Nerone, "A Novel Ballast for Electrodeless Fluorescent Lamps", Conference Record of the 2000 IEEE Industry Applications Conference, vol. 5, 2000, pp. 3330-3337.

* cited by examiner

PREFERRED LIGHTING SPECTRUM AND COLOR SHIFTING CIRCADIAN LAMPS

CROSS-REFERENCE TO RELATED APPLICATIONS

This application claims the benefit of priority to U.S. Provisional Patent Application 62/802,803, filed on Feb. 8, 2019, entitled "PREFERRED LIGHTING SPECTRUM AND COLOR SHIFTING CIRCADIAN LAMPS."

The foregoing application is incorporated herein by reference in its entirety.

BACKGROUND

Field

System, methods, and devices for providing lighting based on circadian patterns.

The color and brightness levels of light sources can have an impact on the way a person feels. This impact is due in part to how we have evolved to respond to natural daily cycles of sunlight as well as to environmental conditions that affect the delivery of sunlight. For instance, a bright sunny day can make you feel like you can tackle anything, but a grey day makes you want to stay on the couch. Light has a lot to do with one's frame of mind, energy level, and restfulness. On a physical level, sunlight is tied to one's circadian rhythm—the body's internal clock.

As part of staying healthy, it is usually beneficial for one to properly set and/or maintain his or her own circadian rhythm. This is typically done in nature by the sun, which provides bright light with a lot of blue during the day, followed by low light levels with minimum blue color in the evening. In modern life, however, traditional artificial lights may interfere with this cycle by being too dim with low amounts of blue light during the day and/or too bright with too much blue light at night. One tends to be more alert, have more energy, and be able to concentrate better under daylight conditions, and be able to relax and enjoy a healthy sleep during evening light conditions. The emergence of low-cost lighting solutions as alternatives to traditional incandescent light have taken great strides in increasing the energy efficiency of artificial lighting, but often at the cost of being disruptive with respect to natural lighting conditions, disrupting one's work and rest.

As a result, there is a need for improved lighting sources that provide energy efficiency while delivering color and brightness levels consummate with one's daily needs for productivity and wellbeing.

SUMMARY

In embodiments, a circadian lighting system is provided that includes a light source and a control circuit in electrical communication with the light source. In embodiments, the control circuit may be in electrical communication with an external device (e.g., an external dimmer control device), where the external device provides an input signal, and where the control circuit is operative to vary a corelated color temperature (CCT) and/or a level of intensity of the light source based on the input signal. In embodiments, based on the input signal, the light source may vary over different ranges, such where the CCT of the light source changes, the intensity of the light source changes, the CCT and the intensity of the light source both change, and the like, where different effects may occur over different ranges of the input signal.

In yet other embodiments, a dimmable circadian lighting system is provided that includes a light source and a control circuit in electrical communication with the light source and a dimmer. The control circuit is operative to vary a CCT of the light source based on a signal from the dimmer, and maintain approximately a same lumen output of the light source across an upper transition zone of the dimmer extending from about 70% or greater of a range of the dimmer to about 100% of the range of the dimmer.

In yet other embodiments, a dimmable circadian lighting system is provided that includes a light source and a control circuit in electrical communication with the light source and a dimmer. The control circuit is operative to vary a CCT of the light source across an upper transition zone of the dimmer extending from about 70% or greater of a range of the dimmer to about 100% of the range of the dimmer, and maintain the CCT of the light source across a lower transition zone of the dimmer that is less than 70% of the range of the dimmer.

In still yet other embodiments, a non-transitory computer readable medium storing instructions is provided. The stored instructions adapt a controller of a dimmable circadian lighting system to vary a CCT of a light source based on a dimmer signal, and maintain approximately a same lumen output of the light source across an upper transition zone of the dimmer extending from about 70% or greater of a range of the dimmer to about 100% of the range of the dimmer.

BRIEF DESCRIPTION OF THE FIGURES

The following detailed description of certain embodiments thereof may be understood by reference to the following figures.

Figure 1A:
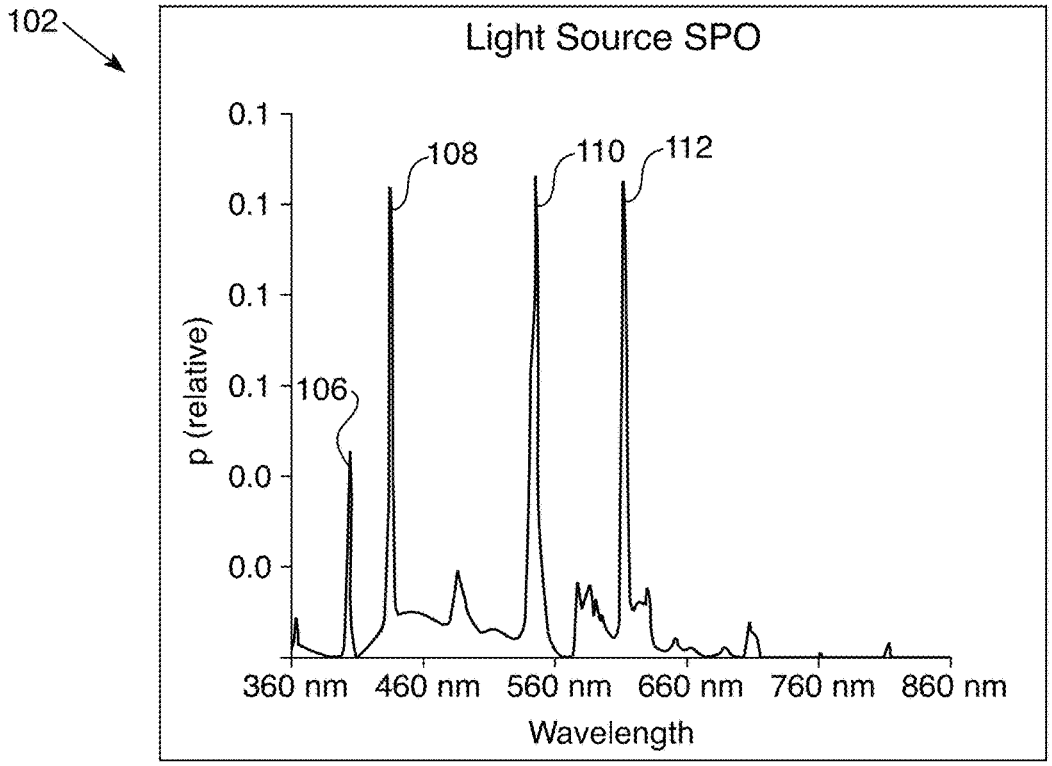
FIG. 1A depicts a spectral power distribution (SPD) for a light source.

While described in connection with certain exemplary and non-limiting embodiments, other exemplary embodiments would be understood by one of ordinary skill in the art and are encompassed herein. It is therefore understood that, as used herein, all references to an "embodiment" or "embodiments" refer to an exemplary and non-limiting embodiment or embodiments, respectively.

DETAILED DESCRIPTION

Reference will be made below in detail to embodiments, examples of which are illustrated in the accompanying drawings. Wherever possible, the same reference characters used throughout the drawings refer to the same or like parts, without duplicative description.

As used herein, the terms "substantially," "generally," and "about" indicate conditions within reasonably achievable manufacturing and assembly tolerances, relative to ideal desired conditions suitable for achieving the functional purpose of a component or assembly. As used herein, "electrically coupled," "electrically connected," and "electrical communication" mean that the referenced elements are directly or indirectly connected such that an electrical current and/or signal may flow/transfer from one to the other. The connection may include a direct conductive connection, i.e., without an intervening capacitive, inductive or active element, an inductive connection, a capacitive connection, and/or any other suitable electrical connection. Intervening components may be present. The connection may also include wireless portions wherein information is communicated from one device to another via electromagnetic radiation, e.g., radio waves and/or laser pulses.

As will be explained in greater detail below, in embodiments, a dimmer may provide for control of the lighting from bright daylight all the way to warm, softer light settings. During more active daytime hours, cooler, brighter light, with more blue light, may improve alertness and productivity while providing sharp, vivid colors and contrast. As will be appreciated, this effect helps reveal beauty to the surroundings, boosts energy and productivity (e.g., great for reading, computer work, writing, cleaning, or crafting), and the like. As the day transitions into the evening, the lamp may be adjusted to a warmer light (e.g., a color temperature of 2700 K) with less blue light to encourage relaxation, enhance social settings, entertaining, family time, reading, dining, and to help transition to sleep. At nearly all light levels, the beauty of an interior environment may be revealed through whiter whites and brighter colors. The warm light setting may dim down smoothly, such as approaching firelight quality, for a relaxing atmosphere that promotes healthy sleep. A person may then wake up fully rested for the next day with an alert and ready mind promoted by appropriate color temperatures and light intensity levels, enabling an environment that's bright when productivity is needed and warm in the evening in correspondence with circadian cycles.

While the embodiments discussed herein concern LED based light sources, it will be understood that the concepts disclosed herein apply to any type of lighting source, e.g., incandescent, fluorescent, induction, OLED, etc.

Additionally, while the circadian patterns discussed herein relate to humans, it will be understood that the circadian patterns of other animals may be used, e.g., dogs, cats, horses, etc.

Figure 1B:
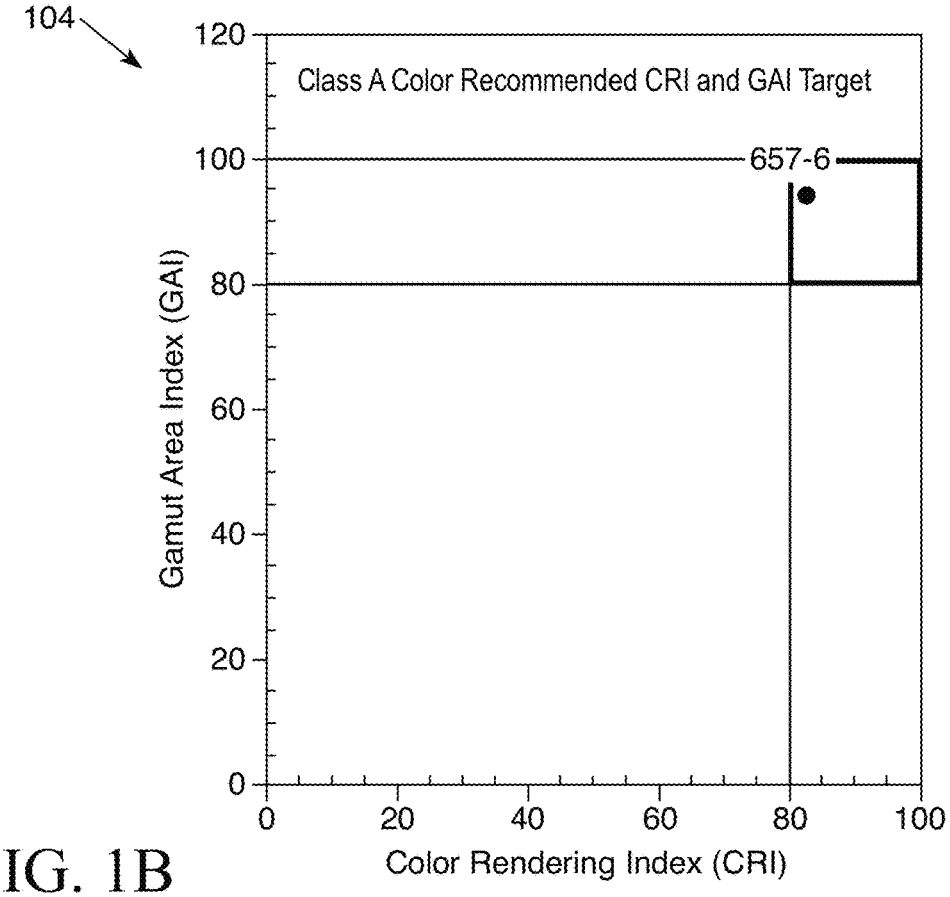
FIG. 1B depicts a chart showing the class A color recommended for combined Gamut Area Index (GAI) and the CIE General Color Rendering Index, Ra ("CRI") for the light source of FIG. 1A.

Accordingly, referring now to FIGS. 1A-B, studies show that one's health and well-being can be improved by home lighting that simulates the natural light one needs throughout the day, while providing clearer brighter colors. For a given lighting color, desired outcomes include whiter whites, brighter colors, attractive skin tones, and the like, with colors matched to desired productivity outcomes with respect to circadian cycles and feelings of wellbeing. 'Whiter whites' may be the result of whiteners found in fabrics, paper, and laundry detergent (e.g., light absorbing at approximately 365 nm and re-emitting at 405-470 nm, or a source of 405 nm light that directly reflects off an object to make that object look brighter). Certain lighting sources may provide light at wavelengths corresponding to absorption characteristics, such as LEDs available at 365 nm and 385 nm, and induction lighting emitting at 365 nm. Brighter colors may be realized through more accurate colors (e.g., not washed out or grey), known as color fidelity (e.g., high CRI or high IES TM-30 $R_f$).

As will be understood, conceptually, CRI and $R_f$ are measures of color fidelity intended to measure the same aspect of color rendition, e.g., "closeness" to a reference source. Because CRI and $R_f$ are typically computed differently, they are often not numerically equivalent but typically remain correlated. On average, $R_f$ is a stricter measure of color fidelity than CRI and therefore most light sources will usually have a lower $R_f$ than CRI, though this is not always the case.

Often a CRI greater than eighty (80) is considered to be good enough, but the market often requires a CRI greater than ninety (90) (although some research indicates most consumers cannot tell the difference between a CRI of eighty (80) and a CRI of ninety (90)). Accordingly, FIGS. 1A-B depict a typical spectral power distribution 102 and corresponding chart 104 showing the class 'A' color recommended for combined Gamut Area Index (GAI) and CRI, with the combined area greater than eighty (80) for both CRI and GAI.

To get brighter colors it may be more desirable to have a high GAI, which is the average increase or decrease of the chroma of objects (relative to those under a reference illuminant), and approximately describes how vivid objects appear. To achieve this, it may be necessary to 'spike' the desired colors, such as spikes 106, 108, 110 and 112 shown in the typical SPD for a light source of FIG. 1A. In addition, the higher the contrast the clearer or brighter an object will appear.

Figure 2:
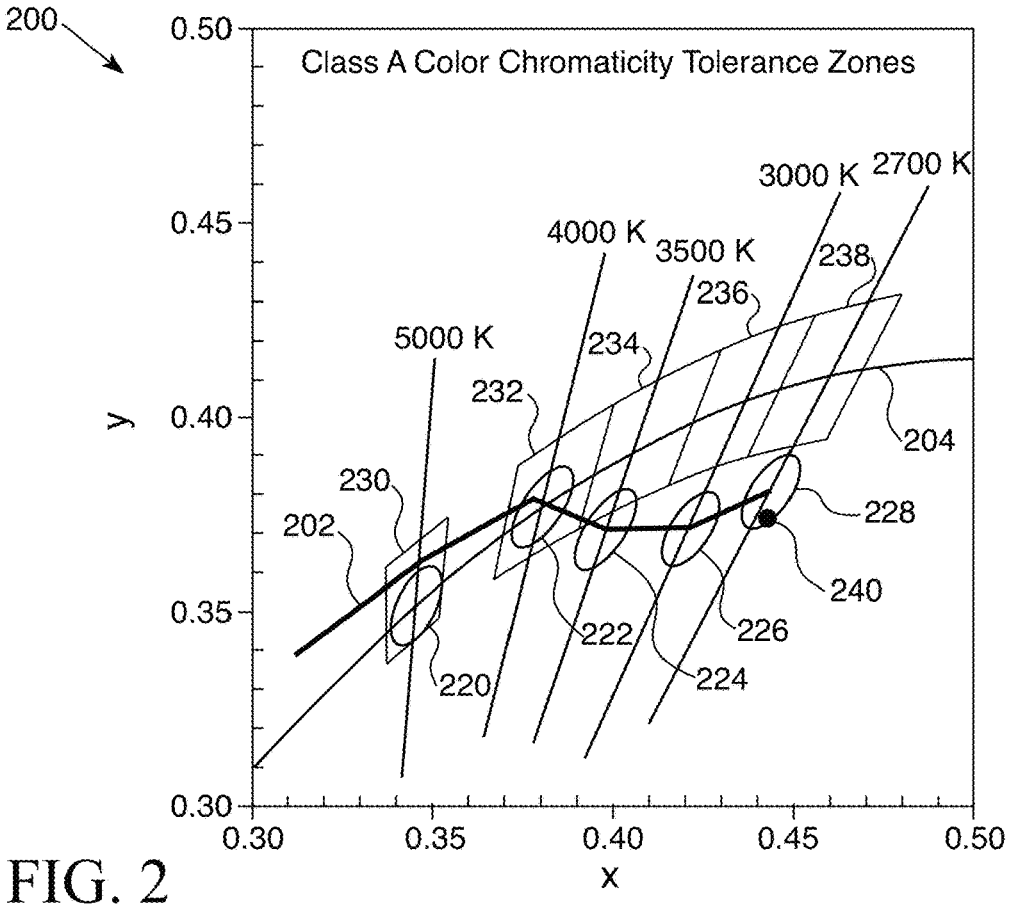
FIG. 2 depicts class A color chromaticity tolerance zones and related minimum tint line.

Turning now to FIG. 2, graph 200 depicts color chromaticity tolerance zones 220, 222, 224, 226 and 228 and a related "minimum tint line" 202. As will be appreciated, the trapezoids 230, 232, 234, 236 and 238 represent standard nominal chromaticity tolerances, as published by ANSI. The point 240 in FIG. 2 represents an example chromaticity, e.g., 679-3, of a light source, such as one having the SPD shown in FIG. 1A, that meets the tolerance for minimum tint at a CCT of about 2700 K. In order to achieve higher contrast, it may be desirable to configure the light source to sit on the minimum tint line 202. For example, a steak on a white background will appear red, while a steak on a green background will appear more red. As will be appreciated, this is because the eye is sensitive and perceives contrast. In another example, a light source may remove the yellow tint from an incandescent lamp (i.e., making the glass appear blue) by configuring the light source to sit near the minimum tint line 202 below the black body curve 204 (as shown in FIG. 2) resulting in objects that appear "brighter" or "clearer". That is, if the light source has a yellow or blue "tint" cast over everything, the contrast will be lower and less clear.

To get more attractive skin tones it may be more desirable to have more reds and oranges to be more flattering, where reds and oranges reflect back strongly to disguise blemishes and uneven skin tone. Yellow light has been shown to make skin more healthful and attractive in appearance. Research has shown the visual effect of yellow tint on perception of healthfulness/attractiveness applies to non-Caucasians as well as Caucasians, where blue light accentuates flaws. Most colors on a Caucasian face reflect blue light, except for red areas which absorb it. Reddish areas, including acne and under-eye circles look dark under blue light and are accentuated. For other facial characteristics there may be different lighting preferences. For example, for Asians it may be desirable to have less yellow, for Caucasians it may be desirable to have more tan, for African Americans it may be desirable to lighten, and the like.

Figure 3:
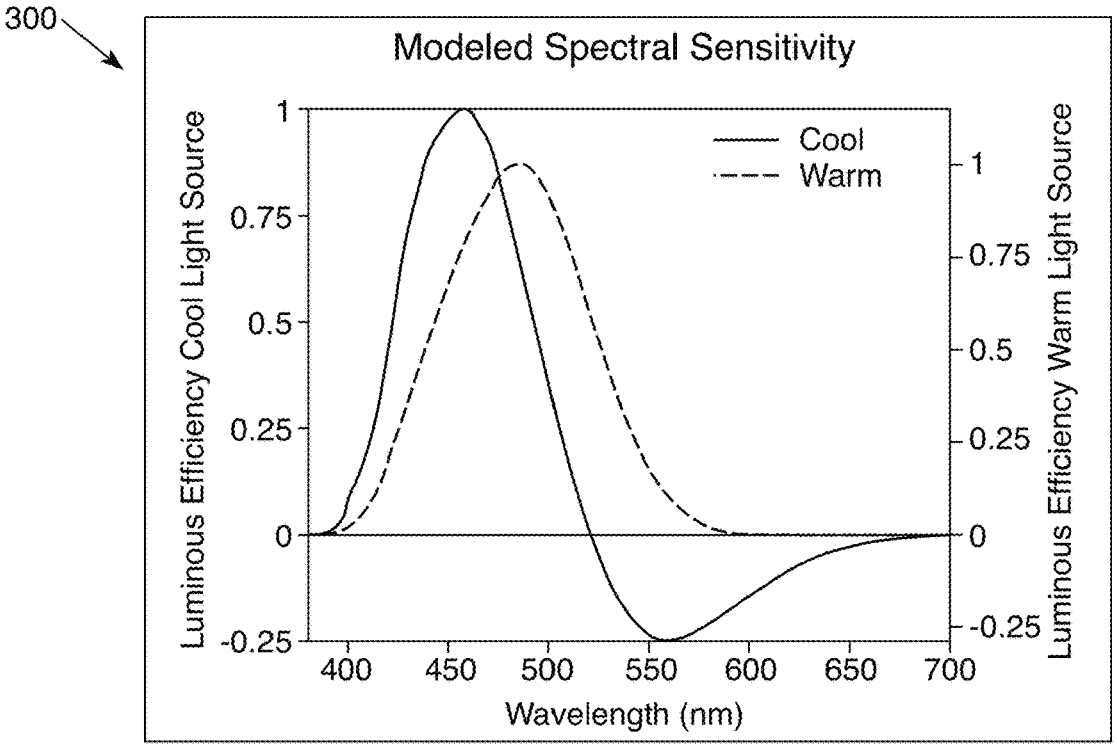
FIG. 3 depicts a modeled spectral sensitivity for circadian light as determined by spectral weighting functions for cool and warm light sources.

Moving to FIG. 3, a graph 300 depicting a modeled spectral sensitivity for circadian light as determined by spectral weighting functions for cool and warm light sources is shown. As will be understood, it has been demonstrated that an overall spectral content of light influences how specific wavelengths affect circadian rhythm. Accordingly, with reference to FIG. 3, circadian light is determined by spectral weighting functions for cool and warm light sources. For instance, short wavelength blue light is most effective in suppressing melatonin production for high CCT ("cool") light sources, while green, yellow, and red spectral content actually contradict and reduce the effect. Short wavelength blue/cyan are most effective in suppressing melatonin production in low CCT ("warm") light sources. Green, yellow, orange and red may have minimal impact.

Figure 4:
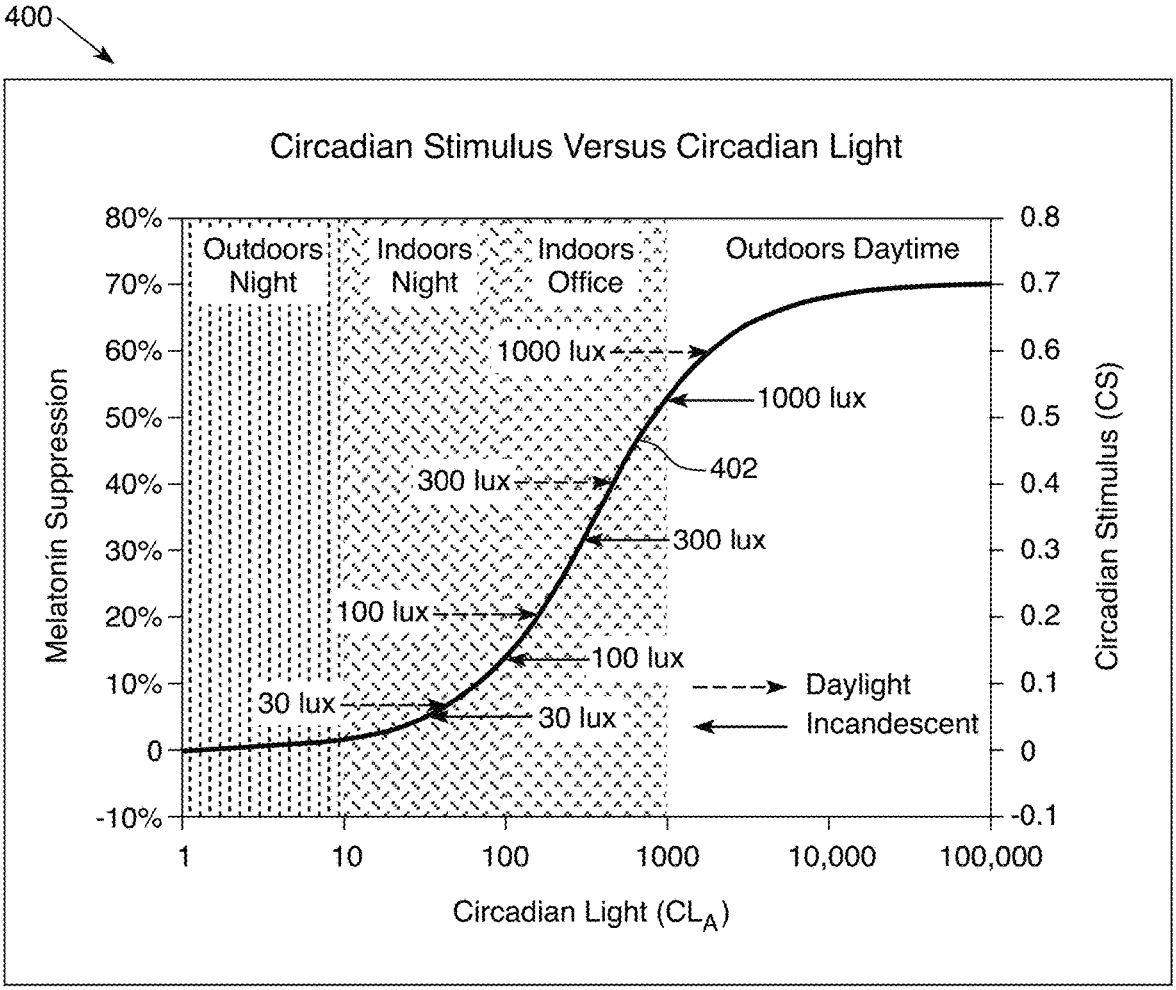
FIG. 4 depicts circadian stimulus verses circadian light.

FIG. 4 depicts a graph 400 derived from measurements of nocturnal melatonin suppression, showing circadian light (CL) 402 as a function of percent of melatonin suppression and circadian stimulus (CS). As will be understood, CS is a measure of human nocturnal melatonin suppression and may be dependent on the quantity and spectrum of light reaching the eyes. The depicted model assumes one (1) hour of exposure to a light source. CS values typically range from 0% (no melatonin suppression) to 70% (maximum melatonin suppression). Average values range from 10-30%. Circadian stimulus levels at different photopic illuminance levels are also depicted. As shown, total light level, measured in "lux" (lumens per square meter), may determine melatonin suppression, weighted by the spectral content of light. Further, high CCT ("cool" or "daylight") light sources are often most effective in suppressing melatonin production, while low CCT ("warm" or incandescent) light sources often allow more melatonin production for the same lux level.

As will be appreciated, the circadian stimulus may be determined by lux level and the spectrum of light at this lux level. For evening hours, circadian stimulus may be less than 0.1, which is equivalent to about seventy-five (75) lux incandescent (1/7 of typical office light level). However, it may be beneficial to maintain higher lux levels (e.g., for safety or fewer work errors) with low CCT ("warm") light sources. Comparing light sources, for instance, 100 lux may be used for 2700 K fluorescent sources, 75 lux for 2700 K incandescent, 75 lux for typical 2700 K LED, 85 lux for typical 5000 K LED, and the like.

In daytime hours, circadian stimulus may be greater than 0.3 to promote sleep at night and alertness and productivity during the day, which may be equivalent to about 300 lux incandescent (60% typical office light level). Comparing light sources, for instance, 255 lux may be for daylight reference, 275 lux for 5000 K broad-spectrum fluorescent, 300 lux for 5000 K fluorescent, 300 lux for 2700 K incandescent, 320 lux for typical 2700 K LED, 325 lux for typical 5000 K LED, 400 lux for 2700 K fluorescent, and the like. During Evening hours, a circadian stimulus less than 0.1 may be necessary for sleep and rest and to be alert and productive during the day.

With respect to lighting and memory retention (such as in a school or work environment), it may be desirable to have bright light, such as 2,000 lux or more. A typical office illumination is 500 lux, as compared to outdoor light levels of 2000-10000 lux. A high CCT, such as 5000 K ("Daylight") or higher with blue content, has been shown to improve alertness and mood, and may be good for brainstorming and the like. Noon skylight has a color of approximately 10000 K. Well distributed diffuse light has often been shown to be best, such as with indirect lighting with significant horizontal illumination. Again, during evening hours a circadian stimulus of less than 0.1 may be necessary for sleep and rest to be alert and productive during the day.

Figure 5A:
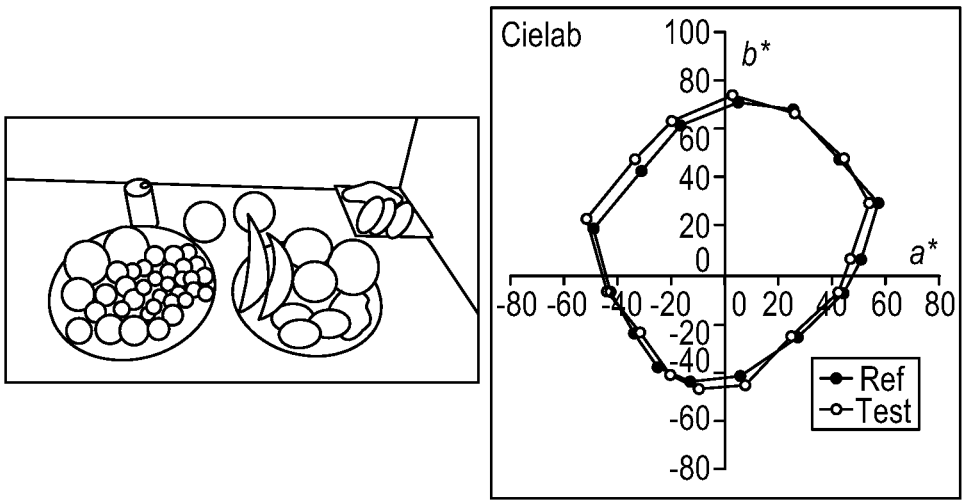
FIG. 5A depicts an example of a light source with high CRI.
Figure 5B:
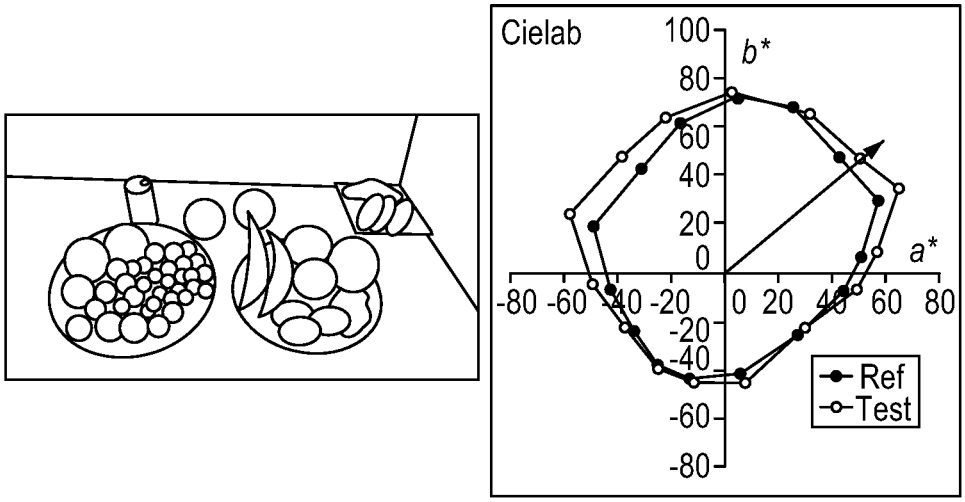
FIG. 5B depicts another color rendering example with enhanced red saturation.
Figure 6A:
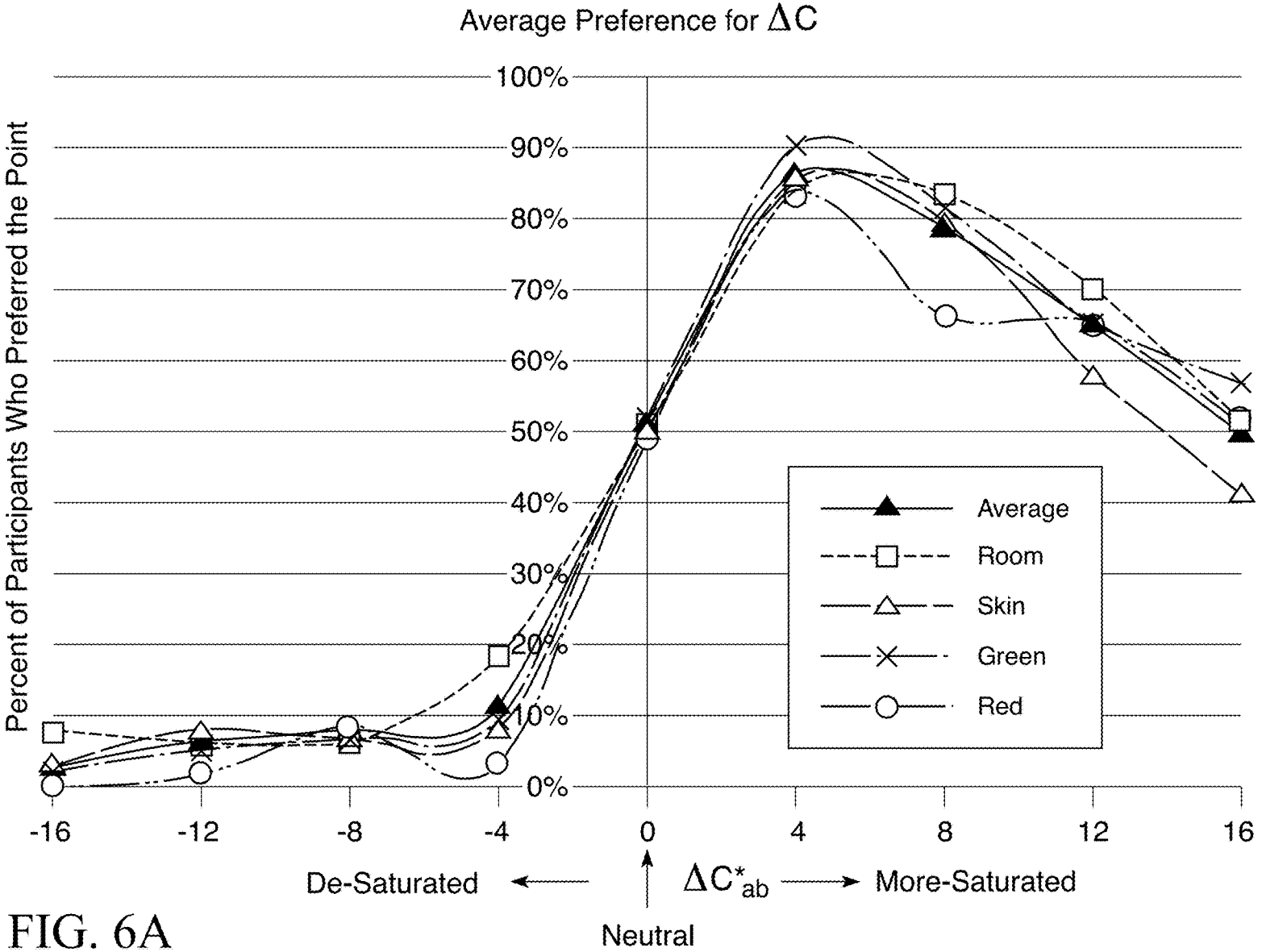
FIG. 6A depicts data showing light sources that increase red chroma increase user preference.
Figure 6B:
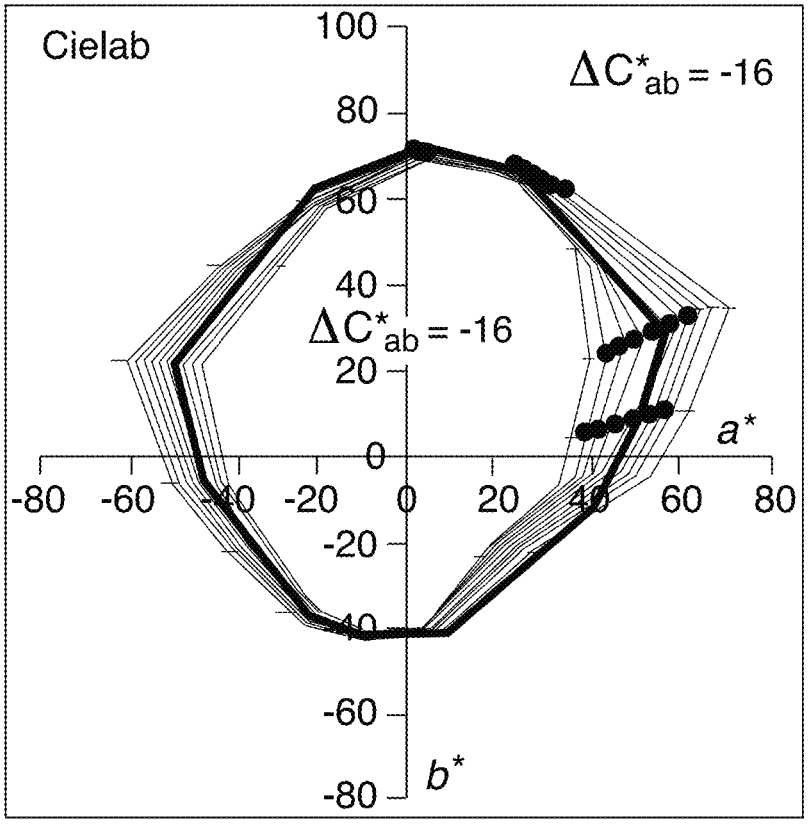
FIG. 6B depicts the visual representation of the Gamut Area of the spectra of FIG. 6A.

With respect to preferred color rendition, FIGS. 5A and 5B depict two (2) color rendering index examples, where a lower CRI of 78 (FIG. 5B) shows colors that are shown to be preferred by consumers compared to a higher CRI of 94 (FIG. 5A). For instance, studies have shown that consumers prefer red and green saturation over high CRI. The many well-known lighting institutions, however, agree CRI is not always the best measure of color quality. As will be appreciated, a confluence of consumer preferences is depicted in FIGS. 6A-B.

Thus, in embodiments, a preferred light spectrum and characteristics may include a CRI>80 and a GAI>80. GAI may benefit from spiked colors to highlight desired colors and make the color rendering more vivid (e.g., spiking for ultraviolet (UV) for whites (e.g., adding 365 nm to excited optical brighteners), spiking Red-Green-Blue (RGB) for best overall experience, and the like). As will be understood, it may be desirable to have lighting on the minimum tint curve 202 (FIG. 2), to oversaturate red and green, not blue and not yellow, and increase short wavelength blue and brightness during the day or when desired, and reduce at night along the appropriate circadian stimulus curve 402 (FIG. 4).

Accordingly, in embodiments, a circadian lamp may be a lamp that promotes circadian processes. A circadian lamp may be a 'fixed' circadian lamp that is constant in its brightness level and color for a given electrical input signal. For example, a daytime fixed circadian lamp may have a color temperature of 5000 K and an evening fixed circadian lamp may have a color temperature of 2700 K.

Figure 7:
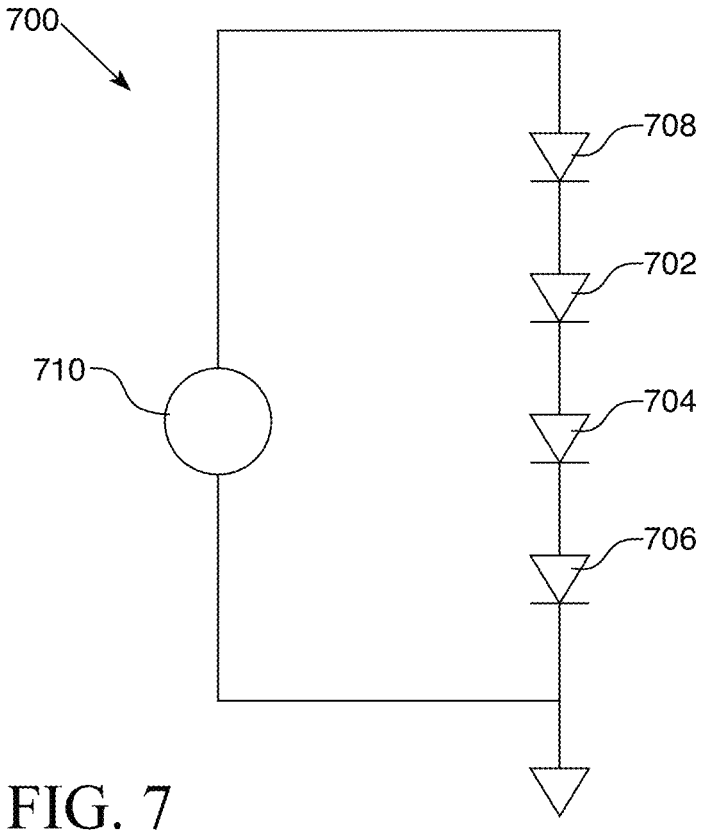
FIG. 7 depicts an LED configuration for a fixed 5000 K light source in accordance with embodiments.

Turning to FIG. 7, an embodiment of a fixed circadian LED lamp/lighting system 700 with a color temperature of 5000 K is shown, wherein the CCT is fixed with a high blue light content (ideal for circadian stimulus and daytime entrainment or work), with red 702 and green 704 LED light added to broad spectrum daylight LED light 706 to enhance GAI, and a UV, violet or deep blue LED 708 to promote bright whites. In embodiments, the lamp 700 may have an AC and/or DC power source 710.

Figure 8:
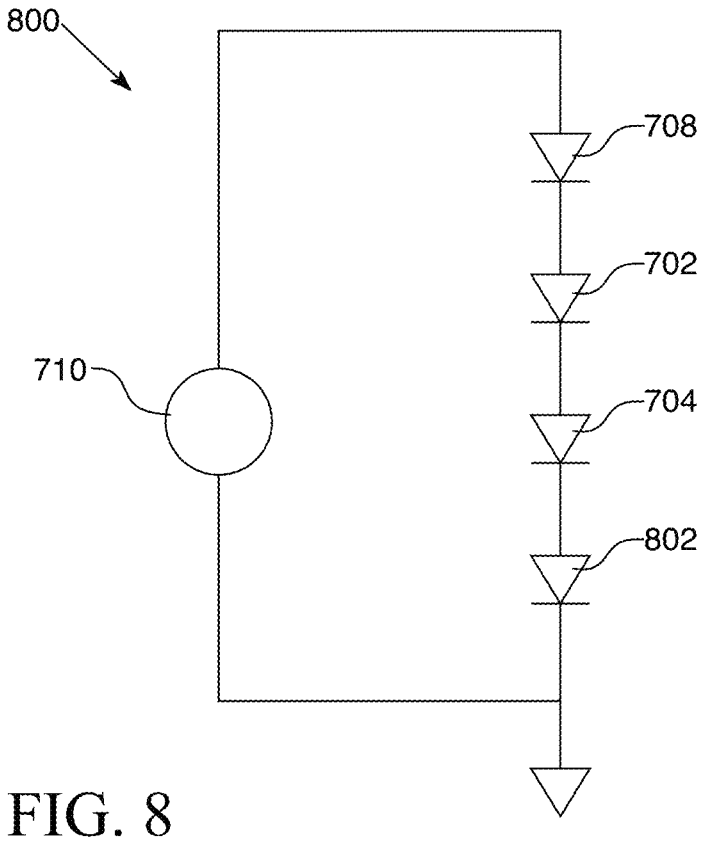
FIG. 8 depicts an LED configuration for a fixed 2700 K light source in accordance with embodiments.

Moving to FIG. 8, an embodiment of a fixed circadian LED lamp/lighting system 800 with a color temperature of 2700 K is shown, wherein the CCT is fixed with low blue light content (ideal for melatonin production and preparation for sleep), red 702 and green LED light 704 added to broad spectrum warm white LED 802 to enhance GAI, and UV LED 708 for bright whites.

Figure 9:
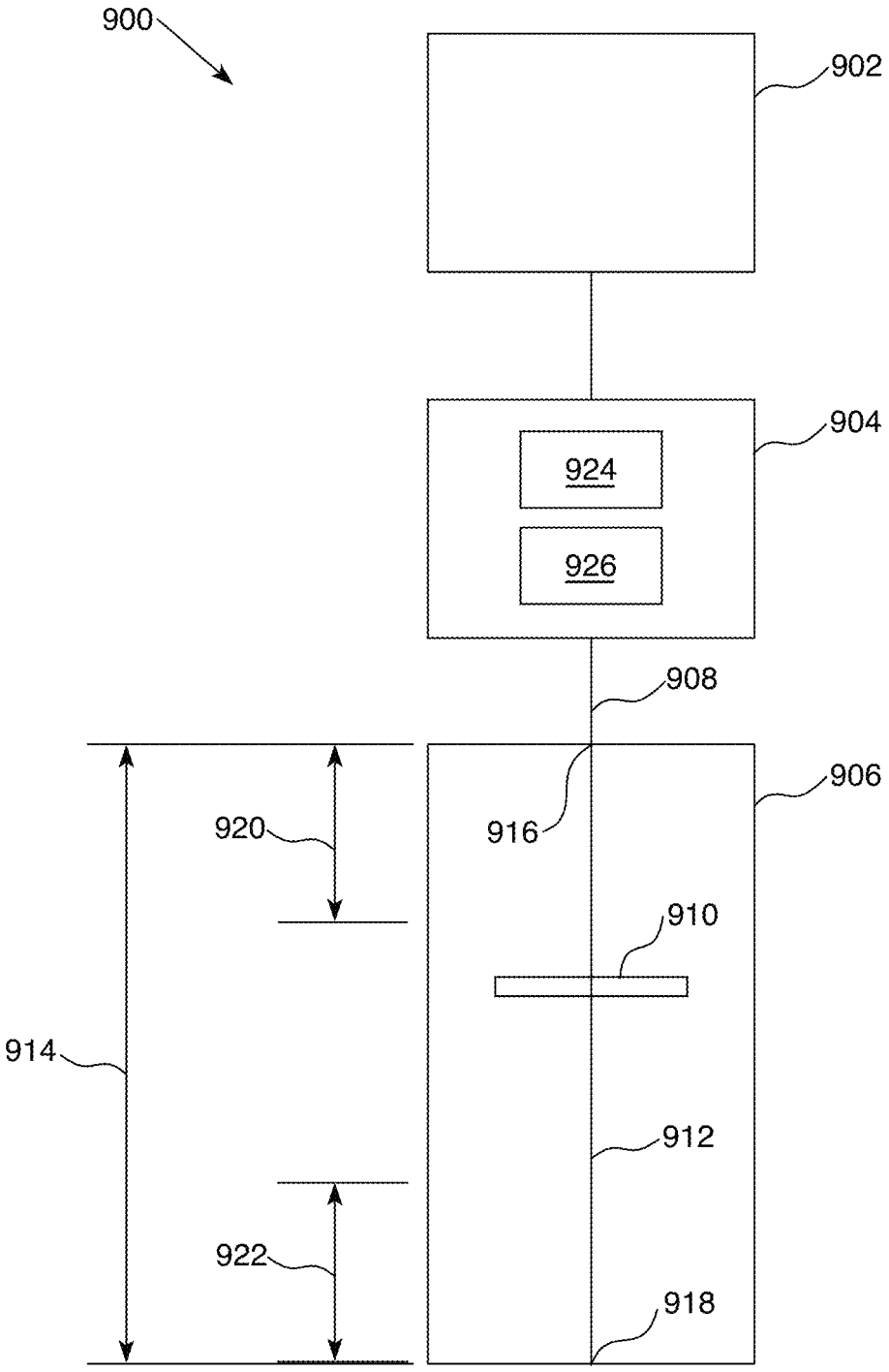
FIG. 9 depicts a variable LED with a dimmer in accordance with embodiments.

Turning to FIG. 9, in embodiments, a circadian lamp may be a variable circadian lamp/dimmable circadian lighting system 900 having a light source 902 and a control circuit/controller 904 in electrical communication with the light source 902 and a dimmer 906. As will be explained in greater detail below, in embodiments, the control circuit 904 is operative to vary the CCT and/or the brightness of the light source 902 based on a signal/output/dim control setting 908 from the dimmer 906.

As shown in FIG. 9, the dimmer 906 may include an adjuster/switch 910 that traverse a track 912 corresponding to a range 914 of the dimmer's 906 output 908. The track 912 may have a first end 916 and a second end 918, and the position of the adjustor 910 may correspond to the percentage of the range 914 being outputted 908 by the dimmer 906. In such embodiments, the first end 916 may correspond to 100% of the range 914 and the second end 918 may correspond to 0% of the range 914. As further shown in FIG. 9, the range 914 may have an upper transition zone 920 and/or a lower transition zone 922. Note that the indications of ranges 920 and 922 in FIG. 9 are meant to be illustrative and not limiting in any way, where an upper transition zone 920 may consist of a range from the first end 916 to any point along the range 914, and the lower transition zone 922 may consist of a range from the second end 918 to any point along the range 914.

While the foregoing example discloses a dimmer 906 having a slidable adjustor 910, it is to be understood that the adjustor 910 may take on other forms. For example, the dimmer 906 may have a circular body and the adjustor 910 may be a needle or dial that rotates about the body. In embodiments, the adjustor 910 may include two or more buttons for increasing and decreasing the output of the dimmer 906. In embodiments, a dim control setting may be sensed in a variety of ways appropriate to the dimming mechanism, e.g., dimmer 906. For instance, the lamp may be adapted for separate control of the CCT and light intensity level by sensing the average line voltage, conduction angle of phase-cut dimmers, current or power output, and the like. Explicit dimming control signals such as "0 to 10V dimming" may be also used. This control scheme may be applied advantageously to change other light quality parameters over the dimming control range as well. Examples include varying chromaticity, color rendering index, Gamut Area Index (saturation), and the like, in addition to CCT. Further, in embodiments, the dimmer 906 may be integrated with the control circuit 904 and/or light source 902, while in other embodiments, the dimmer 906 may be apart from the control circuit 904 and/or light source 902. For example, in embodiments, the dimmer 906 may be apart from the control circuit 904 and communicate wirelessly with the control circuit 904. In embodiments, the dimmer 906 may communicate with the control circuit 904 via a network, e.g., the Internet and/or an intranet.

In embodiments, a circadian lamp/dimmable circadian lighting system may be variable with respect to color temperature and/or intensity/brightness. For example, a variable circadian lamp/dimmable circadian lighting system may enable the brightness to vary, the color temperature to vary, or both the brightness and color temperature to vary. In embodiments, the brightness and color temperature may vary together as a function of a controller, e.g., a control circuit 904 and/or a dimmer 906, input, such as where the color temperature varies at the high end of a dimmer range and both intensity and color temperature vary across the lower end of the dimmer range, color temperature varies at the high end of a dimmer range and the intensity varies across the lower end of the dimmer range, or any other combination thereof. In embodiments, varying color temperature and/or intensity may be implemented through a dimmer control switch, as discussed above, or other type of controller (e.g., mounted on the lamp, controlled through an integrated light sensor, remote controlled, and the like).

In embodiments, the control circuit 904 may include at least one processor 924 and at least one memory device 926 storing instructions that adapt the at least one processor 924 to control the light source 902 based on the output 908 of the dimmer 906 as disclosed herein. In embodiments, the control circuit 904 may include hard-wired logic circuits, one or more PROMs, and/or other types of memory/logic chips.

Figure 10:
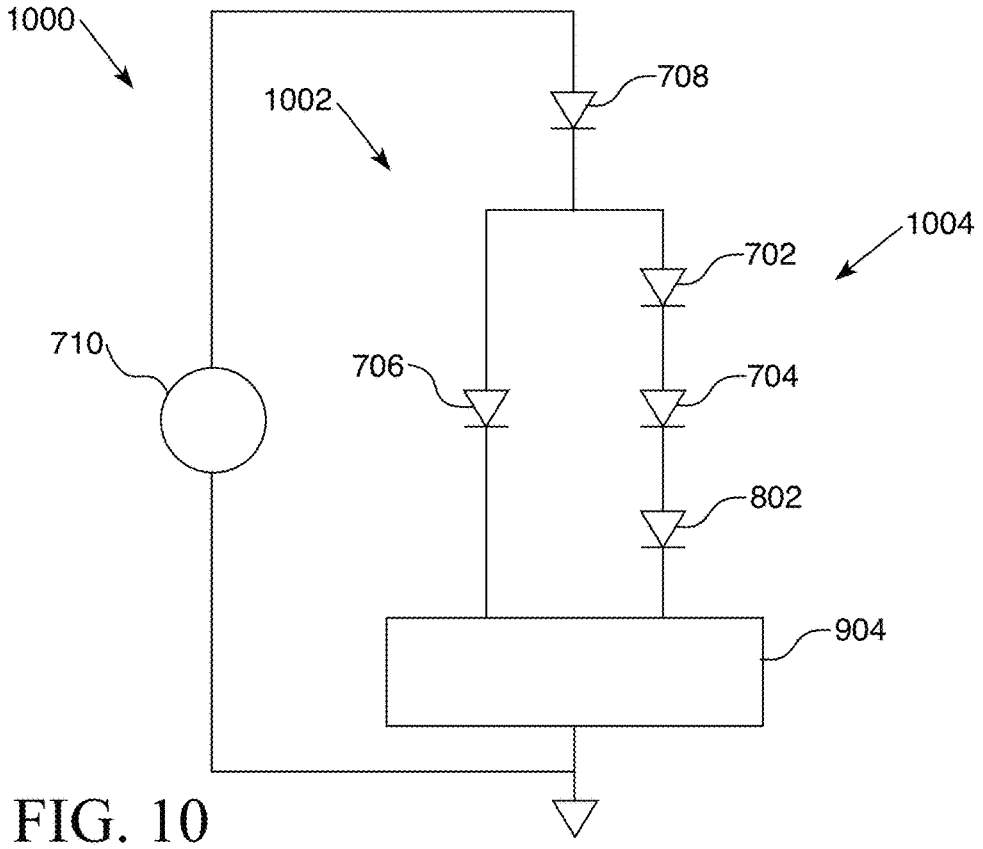
FIG. 10 depicts an LED configuration for a lighting configuration in accordance with embodiments.

FIG. 10 depicts an embodiment of a variable circadian LED lamp/dimmable circadian lighting system 1000, where at maximum power the control/steering circuit 904 may direct most, e.g., the majority, of the current to a "cool" LED string 1002 to produce 5000 K CCT. As power reduces from 100% to 75% (for example), the steering/control circuit 904 progressively directs current to the "warm" LED string 1004 to lower CCT to 2700 K (for example) and minimize blue light content. As power reduces from 75% to 0%, the steering circuit 904 continues to shift current to the warm string 1004 to gradually lower CCT to 2200 K (for example). As will be understood, a UV LED 708 may be included for bright whites.

Figure 11:
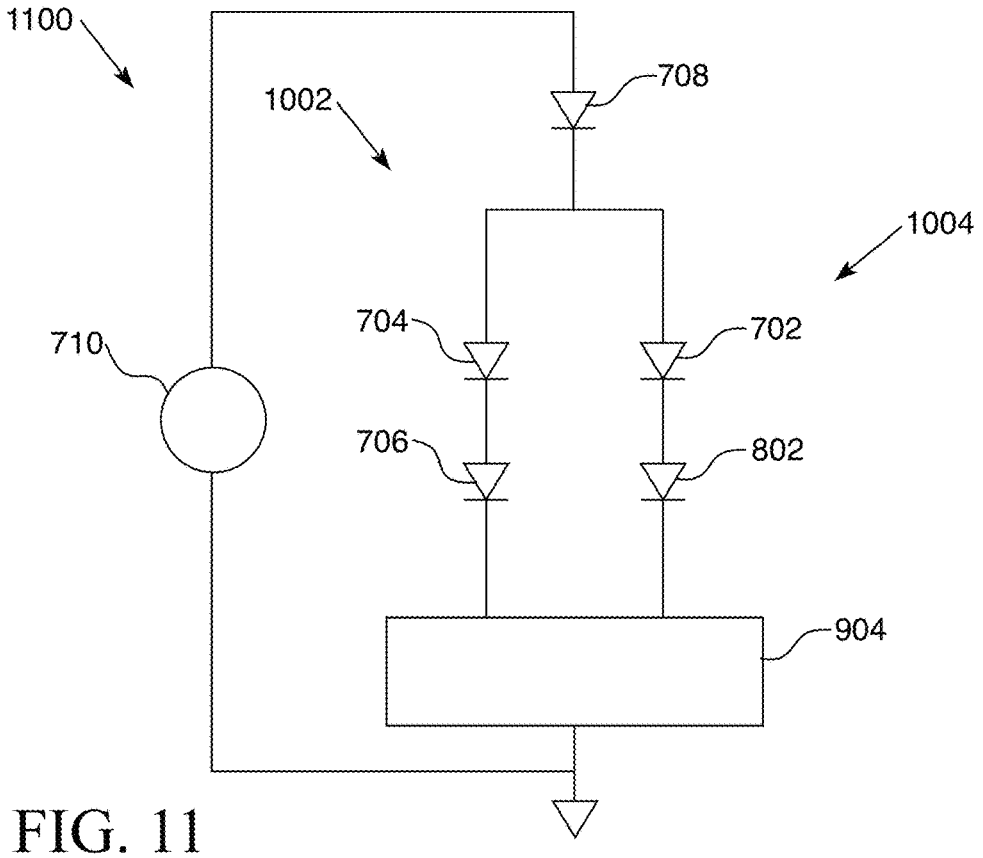
FIG. 11 depicts another LED configuration for a lighting configuration in accordance with embodiments.

FIG. 11 depicts an embodiment of a variable circadian LED lamp/dimmable circadian lighting system 1100, where at maximum power the steering/control circuit 904 may direct most current to the "cool" LED string 1002 to produce 5000 K CCT. As power reduces from 100% to 75% (for example), the steering circuit 904 progressively directs current to the "warm" LED string 1004 to lower CCT to 2700 K (for example) and minimize blue light content. As power reduces from 75% to 0%, the steering circuit 904 continues to shift current to the warm string 1004 to gradually lower CCT to 2200 K (for example). As will be understood, a UV LED 708 may be included for bright whites.

Figure 12:
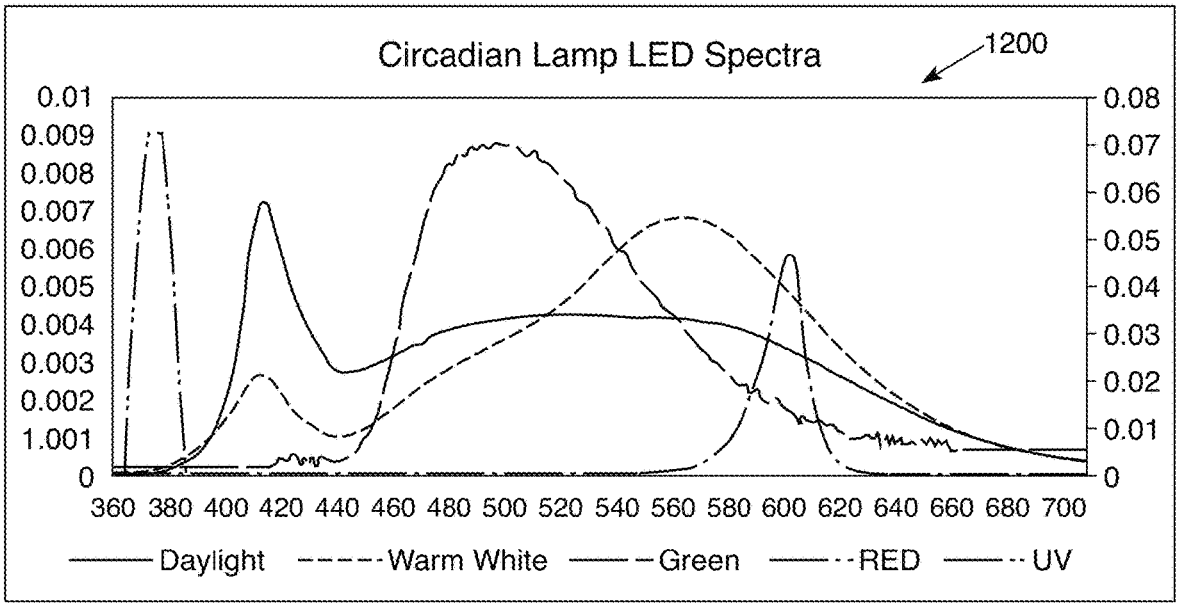
FIG. 12 depicts a circadian lamp LED spectra in accordance with embodiments.

Turning briefly to FIG. 12, an example of circadian lamp LED component spectra 1200 is shown in accordance with embodiments. As will be appreciated, a variable lamp, in accordance with embodiments, may vary the relative output of LEDs producing different wavelengths to produce a wide range of color temperatures (e.g., 5000 K to 2200 K) in response to a dimmer control input in order to reduce the blue light content and therefore reduce the circadian stimulus across the dimming range.

Figure 13:
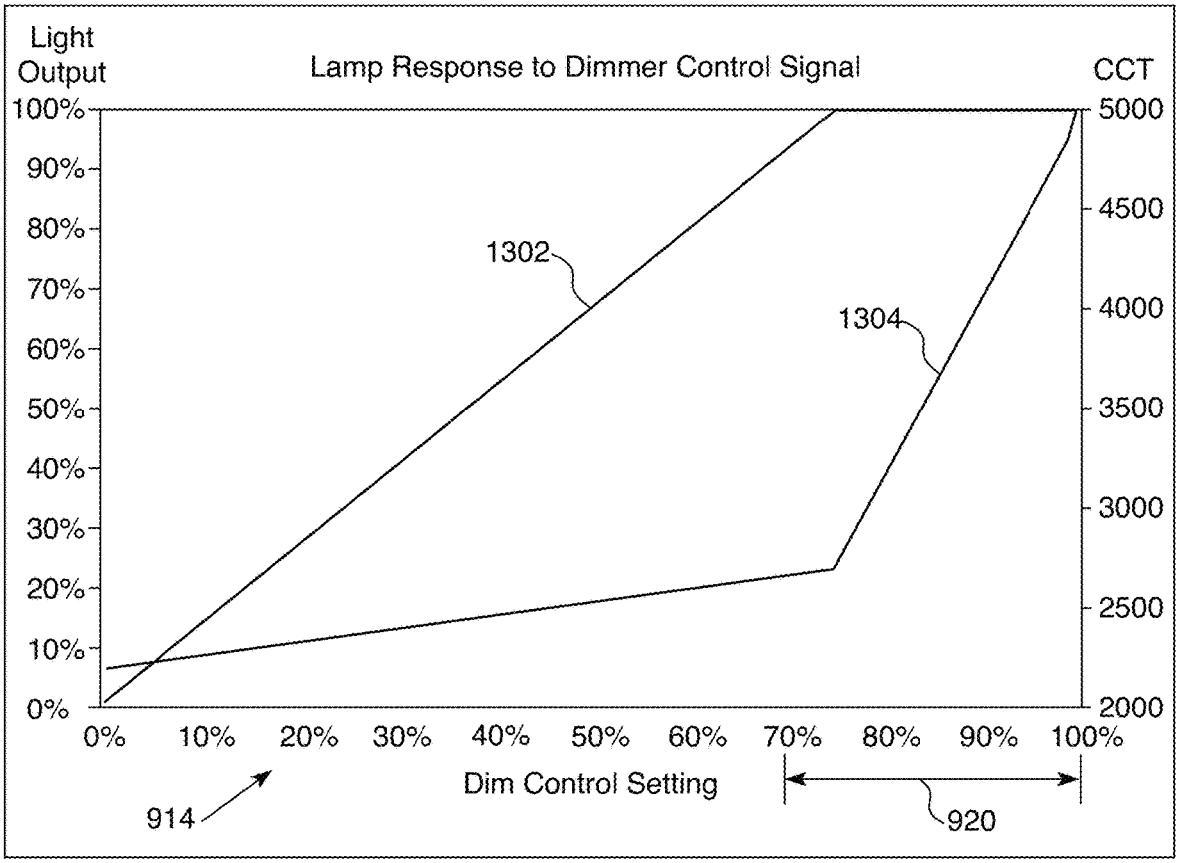
FIG. 13 depicts a graph for lighting control of light output and CCT in accordance with embodiments.
Figure 14A:
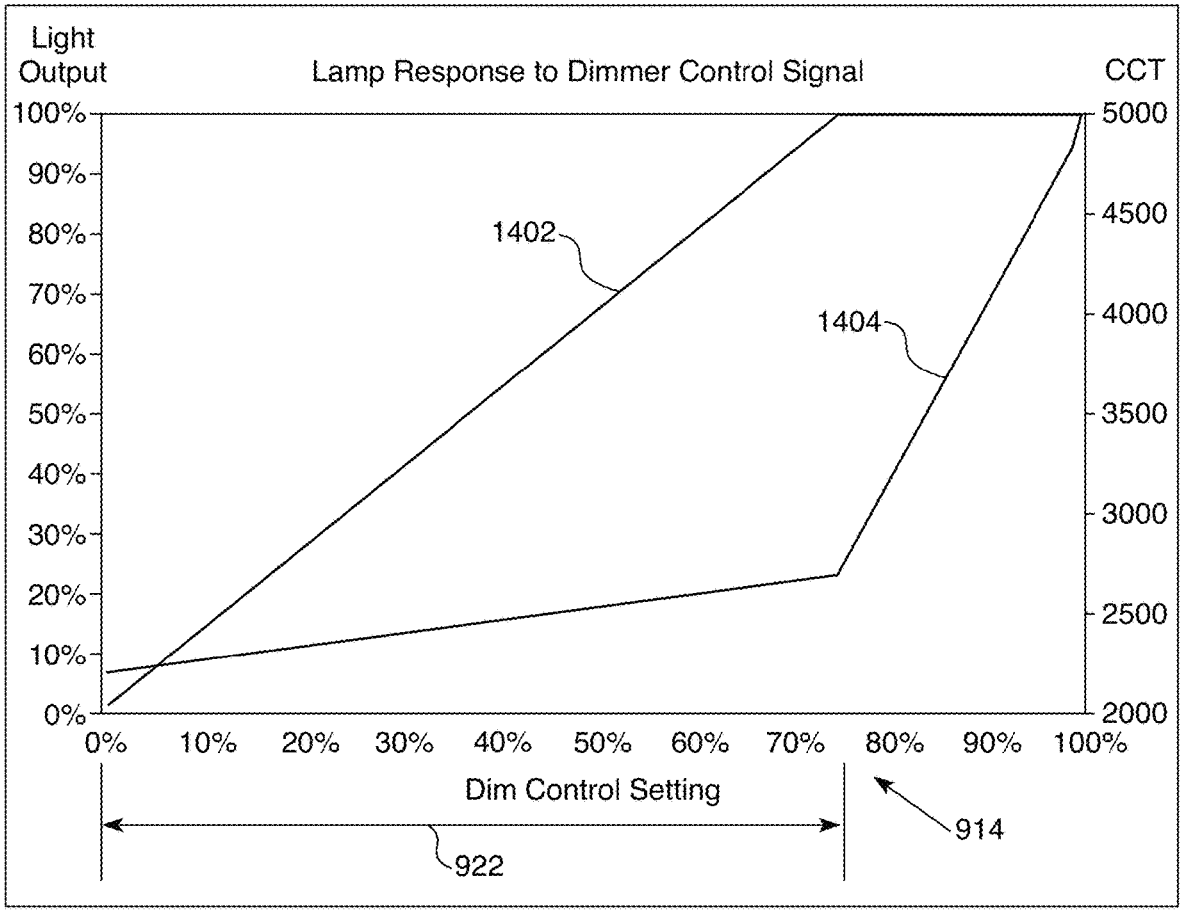
FIG. 14A depicts another graph for lighting control of light output and CCT in accordance with embodiments.
Figure 14B:
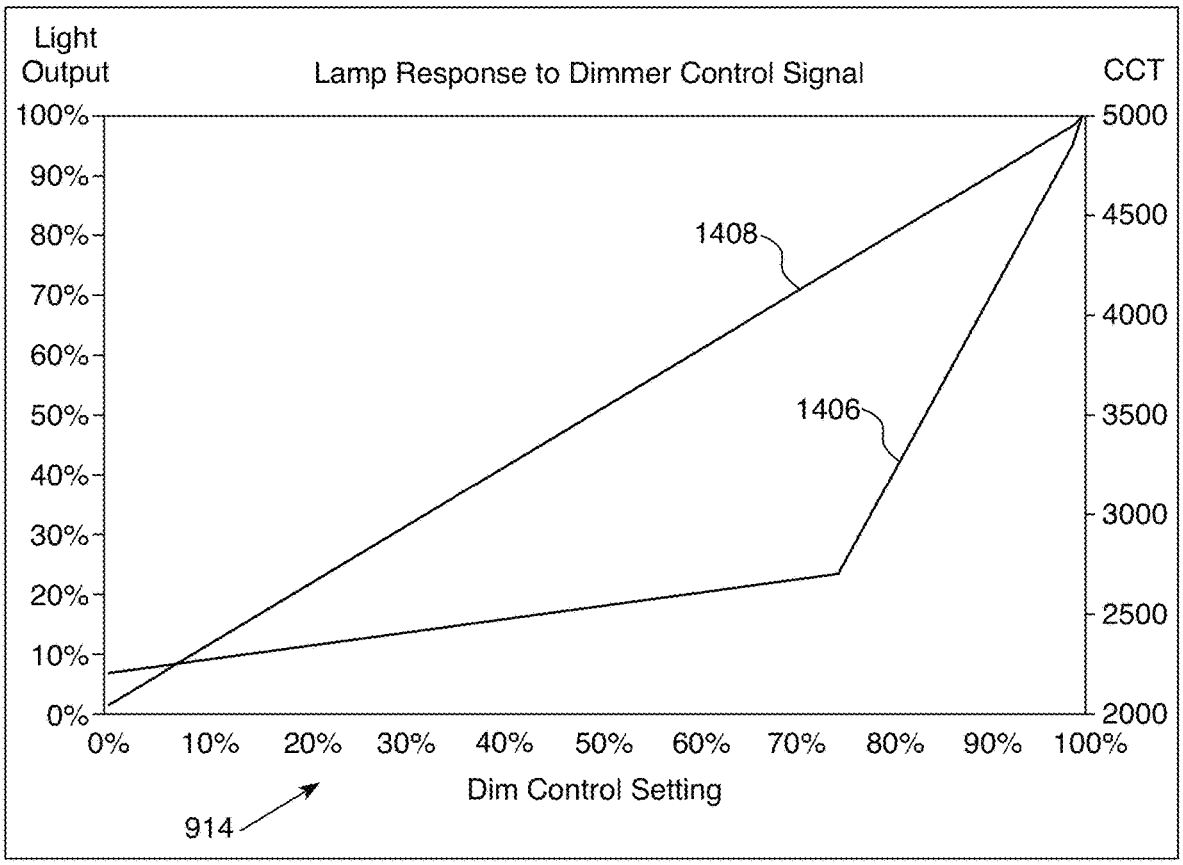
FIG. 14B depicts another graph for lighting control of light output and CCT in accordance with embodiments.
Figure 15:
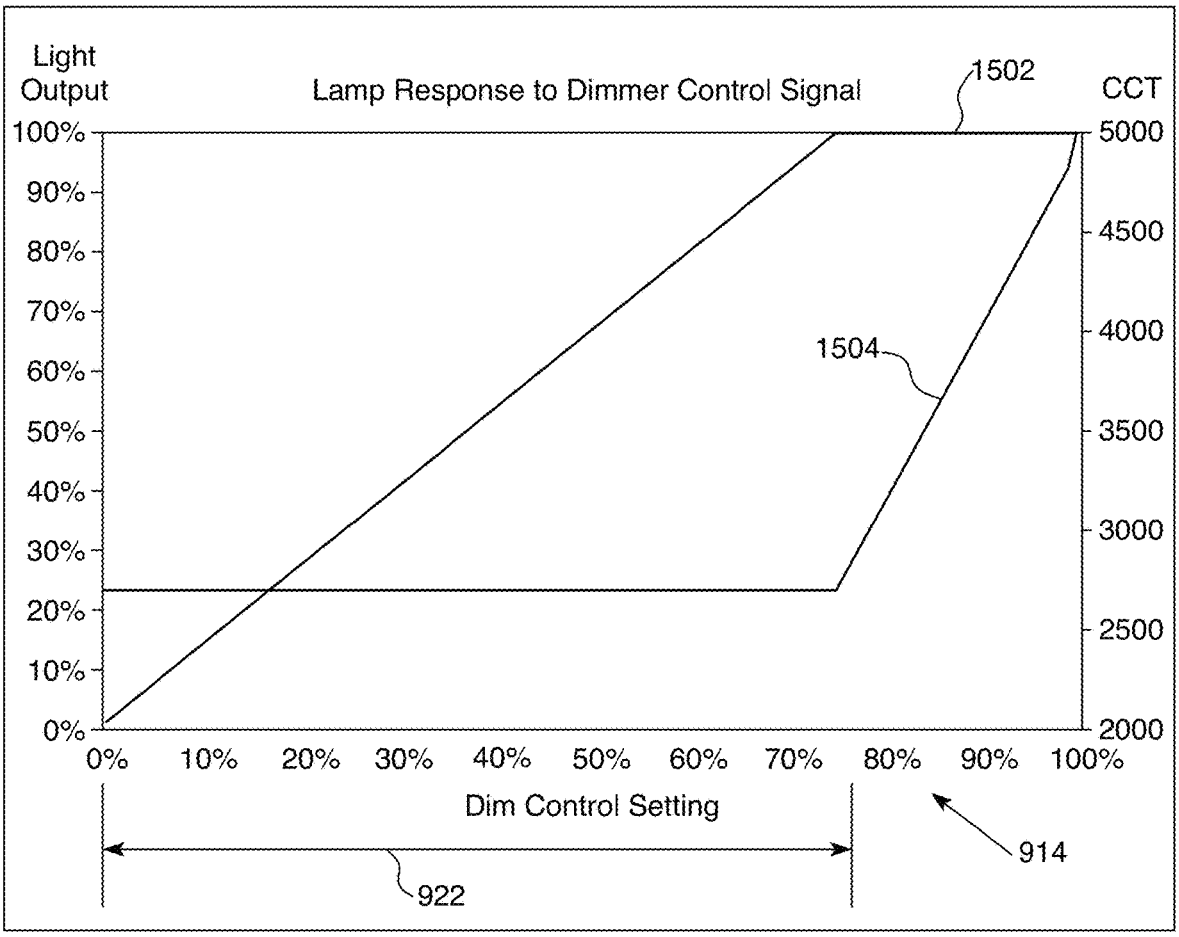
FIG. 15 depicts another graph for lighting control of light output and CCT in accordance with embodiments.

Accordingly, referring now to FIGS. 13-15, several graphs depicting lighting control profiles, in accordance with embodiments, are shown, wherein in each graph: the left vertical axis corresponds to a percentage of the maximum output of a lighting source 902 (FIG. 9); the right vertical axis corresponds to a CCT output of the light source 902; and the horizontal axis corresponds to the range 914 of a dimmer 906 (FIG. 9) in communication with the light source 902. Often, the output of a light source will typically have a lighting control profile that is exponential in light energy output (lumens) to compensate for the logarithmic response of the human eye, so that the brightness perceived by the human eye varies linearly. The light output curves on the left vertical axes of FIGS. 13-15 are intended to represent perceived light output as a percentage of maximum.

As shown in FIG. 13, in embodiments, a variable lamp/lighting system may maintain substantially constant light output, represented by line 1302, as the CCT, represented by line 1304, shifts from "daylight" (e.g., around 5000 K) to "warm white" (e.g., around 2700 K) at the high end of the dimmer control range 914, and then decrease CCT 1304 and light output 1302 to minimum levels over the remainder of the dimmer control range 914. In embodiments, the response function of the CCT 1304 and light levels 1302 at different dimmer control settings 914 may not be limited, where linear and/or non-linear relationships may be utilized. Use of a single control input (e.g., a dimmer level) may provide control of CCT 1304 and blue light over a wide useful range while maintaining desirable light output levels 1302. It may be desirable to have higher light output levels 1302 as the CCT 1304 shifts from, e.g., 5000 K to 2700 K, and then lower light levels 1302 as the CCT 1304 shifts from, e.g., 2700 K to 2200 K. In embodiments, light levels 1302 may shift separately or in conjunction with CCT 1304 shift.

For example, as further shown in FIG. 13, the control circuit 904 (FIG. 9) may maintain approximately the same lumen output 1302 across the upper transition zone 920 of the dimmer control range 914, wherein the upper transition zone 920 may be from about 70% or greater of the range 914 of the dimmer 906 (FIG. 9) to about 100% of the range 914 of the dimmer 906. In such embodiments, the control circuit 904 may be further operative to also increase the CCT 1304 across the upper transition zone 920. In embodiments, the increase may be within a range of about 2700 K to about 5000 K. In other embodiments, the upper transition zone 920 may be larger, such as from about 50% or more of the range 914 of the dimmer 906 (FIG. 9) to about 100% of the range 914 of the dimmer 906.

As illustrated in FIG. 14A the control circuit 904 may decrease the lumen output 1402 while also decreasing the CCT 1404 across the lower transition zone 922. For example, in embodiments, the lower transition zone 922 may be from about 70% to about 0% of the range 914 of the dimmer 906 and the decrease may be within a range of about 2700 K to about 2300 K. In other embodiments, the lower transition zone 922 may be from about 50% to about 0% of the range 914 of the dimmer 906. As in FIG. 14B, in embodiments, the CCT 1406 may shift at a different rate than the light output 1408 over the dimmer range 914.

Moving to FIG. 15, in embodiments, the light output 1502 may be maintained over a portion of the dimmer control range 914, and then a constant CCT 1504 may be maintained while reducing the light output 1502 over the remainder of the dimmer range 914. For example, in embodiments, the control circuit 904 may maintain the CCT 1504 across the lower transition zone 922 which may be from about 75% or less, e.g., 70%, of the range 914 to about 0% of the range 914. In such embodiments, the CCT 1504 may be maintained at approximately 2700 K.

Referring back to FIG. 2, in embodiments, the control circuit 904 (FIG. 9) may be operative to regulate at least one of a chromaticity of the light source, a color fidelity index (such as CRI or IES TM-30 $R_f$), and/or an index of Gamut Area (such as the Gamut Area Index or IES TM-30 $R_g$) of the light source. As will be appreciated, by varying the chromaticity with CCT, light quality or user preferability may be improved by tracking the "minimum tint" 202 path or an approximation of it in color space. The plot 200 identifies minimum tint points 220, 222, 224, 226, 228 (depicted as ellipses on the plot) on the CIE 1931 x, y chromaticity diagram, with a path through them as a function of CCT (the minimum tint path). Depicted is one possible 'straight-line path', e.g., minimum tint line 202, from 5000 K to 2700 K, although it may be possible to follow other curves through color space.

Further, in embodiments, the light source 902 (FIG. 9) may have a CS<0.15 at 150 lux at the bottom of the dimmer range 914 (FIG. 9), e.g., approximately 0%, and/or a CS>0.33 at 300 lux at the top of the dimmer range 914, e.g., approximately 100%.

Further still, in embodiments, the light source 902 may have a melanopic ratio (MP)<0.4 at the bottom of the dimmer range 914, e.g., approximately 0%, and/or a MP>0.9 at 300 lux at the top of the dimmer range 914, e.g., approximately 100%. As will be understood, as used herein, the MP of a light source refers to a measure of the ratio of the melanopic to photopic content in the light source spectral power distribution, which may be modified by an arbitrary scaling factor to make MP=1.0 for the equal energy illuminant.

Finally, it is to be understood that the dimmable circadian lighting systems disclosed herein may include the necessary electronics, software, memory, storage, databases, firmware, logic/state machines, microprocessors, communication links, displays or other visual or audio user interfaces, printing devices, and any other input/output interfaces to perform the functions described herein and/or to achieve the results described herein, which may be executed in real-time. For example, as stated above, the systems may include at least one processor 924 (FIG. 9) and system memory/data storage structures 926 (FIG. 9) in the form of a controller 904 (FIG. 9) that electrically communicates with one or more of the components of the system. The memory may include random access memory ("RAM") and read-only memory ("ROM"). The at least one processor may include one or more conventional microprocessors and one or more supplementary co-processors such as math co-processors or the like. The data storage structures discussed herein may include an appropriate combination of magnetic, optical and/or semiconductor memory, and may include, for example, RAM, ROM, flash drive, an optical disc such as a compact disc and/or a hard disk or drive.

Additionally, a software application that provides for control over one or more of the various components of the systems may be read into a main memory of the at least one processor from a computer-readable medium. The term "computer-readable medium," as used herein, refers to any medium that provides or participates in providing instructions to the at least one processor (or any other processor of a device described herein) for execution. Such a medium may take many forms, including but not limited to, non-volatile media and volatile media. Non-volatile media include, for example, optical, magnetic, or opto-magnetic disks, such as memory. Volatile media include dynamic random-access memory ("DRAM"), which typically constitutes the main memory. Common forms of computer-readable media include, for example, a floppy disk, a flexible disk, hard disk, magnetic tape, any other magnetic medium, a CD-ROM, DVD, any other optical medium, a RAM, a PROM, an EPROM or EEPROM (electronically erasable programmable read-only memory), a FLASH-EEPROM, any other memory chip or cartridge, or any other medium from which a computer can read.

While in embodiments, the execution of sequences of instructions in the software application causes the at least one processor to perform the methods/processes described herein, hard-wired circuitry may be used in place of, or in combination with, software instructions for implementation of the methods/processes. Therefore, embodiments are not limited to any specific combination of hardware and/or software.

It is further to be understood that the above description is intended to be illustrative, and not restrictive. For example, the above-described embodiments (and/or aspects thereof) may be used in combination with each other. Additionally, many modifications may be made to adapt a particular situation or material to the teachings of an embodiment without departing from its scope.

For example, embodiments may provide for a dimmable circadian lighting system that includes a light source and a control circuit in electrical communication with the light source and a dimmer. The control circuit is operative to vary a CCT of the light source based on a signal from the dimmer; and maintain approximately a same lumen output of the light source across an upper transition zone of the dimmer extending from about 70% or greater of a range of the dimmer to about 100% of the range of the dimmer. In certain embodiments, across the upper transition zone of the dimmer, the control circuit is further operative to increase the CCT of the light source. In certain embodiments, the increase is within a range of about 2700 K to about 5000 K. In certain embodiments, across a lower transition zone of the dimmer that is about 20% to about 0% of the range of the dimmer, the control circuit is further operative to decrease the lumen output of the light source while also decreasing the CCT of the light source. In certain embodiments, the decrease is within a range of about 2700 K to about 2300 K. In certain embodiments, across a lower transition zone of the dimmer that is about than 70% or less of the range of the dimmer, the control circuit is further operative to maintain the CCT of the light source. In certain embodiments, the CCT is maintained at approximately 2700 K. In certain embodiments, the light source includes a blue light, a red light, a green light, an ultraviolet light and a warm white light. In certain embodiments, when the dimmer is set to about 100% of its range, the control circuit directs more electrical current to the blue light than to the red, green and warm white lights. In certain embodiments, when the dimmer is set to about 100% of its range, the control circuit directs more electrical current to the blue and green lights than to the red and warm white lights. In certain embodiments, the light source includes at least one light emitting diode. In certain embodiments, the control circuit is further operative to generate a whitening effect. In certain embodiments, the whitening effect may be provided by a blue light. In certain embodiments, the blue light may be in the range of about 365 nm to about 420 nm. In certain embodiments, the control circuit is further operative to regulate at least one of a chromaticity of the light source, a color rendering index of the light source, and a Gamut Area Index of the light source. In certain embodiments, the light source has a CS less than about 0.15 at about 150 lux at a bottom of the range of the dimmer, and a CS greater than about 0.33 at about 300 lux at a top of the range of the dimmer. In certain embodiments, the light source has a MP less than about 0.4 at a bottom of the range of the dimmer and a MP greater than about 0.9 at about 300 lux at a top of the range of the dimmer.

Other embodiments may provide for a dimmable circadian lighting system that includes a light source and a control circuit in electrical communication with the light source and a dimmer. The control circuit is operative to vary a CCT of the light source across an upper transition zone of the dimmer extending from about 70% or greater of a range of the dimmer to about 100% of the range of the dimmer, and maintain the CCT of the light source across a lower transition zone of the dimmer that is less than 70% of the range of the dimmer. In certain embodiments, the CCT is maintained at approximately 2700 K. In certain embodiments, the light source includes one or more light emitting diodes.

Yet other embodiments may provide for a non-transitory computer readable medium storing instructions. The stored instructions adapt a controller of a dimmable circadian lighting system to vary a CCT of a light source based on a dimmer signal, and maintain approximately a same lumen output of the light source across an upper transition zone of the dimmer extending from about 70% or greater of a range of the dimmer to about 100% of the range of the dimmer. In certain embodiments, the instructions further adapt the controller to increase the CCT of the light source across the upper transition zone of the dimmer. In certain embodiments, the instructions further adapt the controller to maintain the CCT of the light source across a lower transition zone of the dimmer that is about 70% or less of the range of the dimmer. In certain embodiments, the light source includes a blue light, a red light, a green light, an ultraviolet light and a warm white light.

Accordingly, by providing for a circadian lamp/system, some embodiments may make it very easy to get the light one needs to set one's circadian rhythm for good health, simply by adjusting a dimmer switch.

Further, embodiments of the dimmable circadian lighting lamps/systems disclosed herein may provide for high brightness and daylight qualities (blue light) needed for circadian stimulus (alertness and setting one's body clock) when the dimmer is set to its full-on, e.g., 100% range, position; while also providing for the ability to adjust light to a more relaxed warm white/soft white color temperature with less blue light for later in the day when relaxation and preparation for sleep is desired. As will be appreciated, such an adjustment may be accomplished by simply by turning down the dimmer switch slightly.

Other embodiments may provide for a light output that does not initially dim significantly so that there is plenty of light for afternoon and evening tasks (e.g., cooking, reading, etc.); but by turning the dimmer down further, the light output may reduce smoothly with the light color becoming more warm, e.g., approaching firelight qualities at the lowest dimmer setting.

Further, some dimmable circadian lighting lamps/systems in accordance with embodiments may: produce "bright whites" at all dimmer settings; show brighter, more pleasing colors; and/or make it simple for a user to set the circadian stimulus to suit their daily schedule, whether it starts early or late in the morning or even is shifted for night work.

While the dimensions and types of materials described herein are intended to define the parameters of the disclosed embodiments, they are by no means limiting. Many other embodiments will be apparent to those of skill in the art upon reviewing the above description. The scope of the disclosed embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted as such, unless and until such claim limitations expressly use the phrase "means for" followed by a statement of function void of further structure.

This written description uses examples to disclose several embodiments, including the best mode, and also to enable one of ordinary skill in the art to practice the embodiments, including making and using any devices or systems and performing any incorporated methods. The patentable scope of the disclosed embodiments is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described embodiments, without departing from their spirit and scope, it is intended that all of the subject matter of the above description shown in the accompanying drawings shall be interpreted merely as examples illustrating the novel concepts herein and shall not be construed as limiting.

What is claimed is:

1. A dimmable circadian lighting system comprising: a light source; and a control circuit in electrical communication with the light source and a dimmer; wherein the control circuit is operative to: vary a correlated color temperature (CCT) of the light source based on a signal from the dimmer, wherein operation of the dimmer causes the control circuit to vary the CCT across the range of the dimmer; maintain approximately a same lumen output of the light source across an upper transition zone of the range extending from about 70% or greater of the range of the dimmer to about 100% of the range of the dimmer; and wherein across a lower transition zone of the dimmer that is from about 70% or less of the range of the dimmer to about 0% of the range of the dimmer, the control circuit is further operative to maintain the CCT of the light source.

2. The dimmable circadian lighting system of claim 1, wherein across the upper transition zone of the range, the control circuit is further operative to increase the CCT of the light source.

3. The dimmable circadian lighting system of claim 2, wherein the CCT is increased over a range of about 2700 K to about 5000 K.

4. The dimmable circadian lighting system of claim 1, wherein across a lower transition zone of the dimmer that is from about 20% to about 0% of the range of the dimmer, the control circuit is further operative to decrease the lumen output of the light source while also decreasing the CCT of the light source.

5. The dimmable circadian lighting system of claim 4, wherein the CCT is decreased over a range of about 2700 K to about 2300 K.

6. The dimmable circadian lighting system of claim 1, wherein the CCT is maintained at approximately 2700 K.

7. The dimmable circadian lighting system of claim 1, wherein the light source includes a blue light, a red light, a green light, an ultraviolet light and a warm white light.

8. The dimmable circadian lighting system of claim 7, wherein, when the dimmer is set to about 100% of its range, the control circuit directs more electrical current to the blue light than to the red, green and warm white lights.

9. The dimmable circadian lighting system of claim 7, wherein, when the dimmer is set to about 100% of its range, the control circuit directs more electrical current to the blue and green lights than to the red and warm white lights.

10. The dimmable circadian lighting system of claim 1, wherein the light source includes at least one light emitting diode.

11. The dimmable circadian lighting system of claim 1, wherein the control circuit is further operative to generate a whitening effect.

12. The dimmable circadian lighting system of claim 1, wherein the control circuit is further operative to regulate at least one of a chromaticity of the light source, a color rendering index of the light source, and a Gamut Area Index of the light source.

13. The dimmable circadian lighting system of claim 1, wherein the light source has a circadian stimulus less than about 0.15 at about 150 lux at a bottom of the range of the dimmer, and a circadian stimulus greater than about 0.33 at about 300 lux at a top of the range of the dimmer.

14. The dimmable circadian lighting system of claim 1, wherein the light source has a melanopic ratio less than about 0.4 at a bottom of the range of the dimmer and a melanopic ratio greater than about 0.9 at about 300 lux at a top of the range of the dimmer.

15. A dimmable circadian lighting system comprising:

a light source;

a control circuit in electrical communication with the light source and a dimmer, wherein the dimmer varies the light source across a range of the dimmer;

wherein the control circuit is operative to:

vary a correlated color temperature (CCT) of the light source across an upper transition zone of the range extending from about 70% or greater of the range of the dimmer to about 100% of the range of the dimmer; and maintain the CCT of the light source across a lower transition zone of the range that is less than 70% of the range of the dimmer.

16. The dimmable circadian lighting system of claim 15, wherein the CCT is maintained at approximately 2700 K.

17. The dimmable circadian lighting system of claim 15, wherein the light source includes one or more light emitting diodes.

18. A non-transitory computer readable medium storing instructions that adapt a controller of a dimmable circadian lighting system to: vary a correlated color temperature (CCT) of a light source based on a dimmer signal, wherein operation of the dimmer causes the control circuit to vary the CCT across the range of the dimmer; maintain approximately a same lumen output of the light source across an upper transition zone of the range extending from about 70% or greater of the range of the dimmer to about 100% of the range of the dimmer; and wherein across a lower transition zone of the dimmer that is from about 70% or less of the range of the dimmer to about 0% of the range of the dimmer, the control circuit is further operative to maintain the CCT of the light source.

19. The non-transitory computer readable medium of claim 18, wherein the instructions further adapt the controller to:

increase the CCT of the light source across the upper transition zone of the range.

* * * * *